US008881750B2

(12) United States Patent
Braun et al.

(10) Patent No.: US 8,881,750 B2
(45) Date of Patent: Nov. 11, 2014

(54) CONVEYOR WAREWASHER HAVING AN AUTOMATIC WASTEWATER REMOVAL SYSTEM

(75) Inventors: Harry Braun, Offenburg (DE); Harald Disch, Elzach (DE); Markus Heidt, Offenburg (DE)

(73) Assignee: PREMARK FEG L.L.C., Glenview, IL (US)

( * ) Notice: Subject to any disclaimer, the term of this patent is extended or adjusted under 35 U.S.C. 154(b) by 0 days.

(21) Appl. No.: 13/500,684

(22) PCT Filed: Aug. 17, 2010

(86) PCT No.: PCT/US2010/045685

§ 371 (c)(1),
(2), (4) Date: Apr. 6, 2012

(87) PCT Pub. No.: WO2011/043864

PCT Pub. Date: Apr. 14, 2011

(65) Prior Publication Data

US 2012/0199166 A1 Aug. 9, 2012

(30) Foreign Application Priority Data

Oct. 8, 2009 (DE) ..... 10 2009 048 810

(51) Int. Cl.

| | |
|---|---|
| ***B08B 3/04*** | (2006.01) |
| ***B08B 3/00*** | (2006.01) |
| ***A47L 15/42*** | (2006.01) |
| ***A47L 15/24*** | (2006.01) |

(52) U.S. Cl.

CPC ..... *A47L 15/4204* (2013.01); *A47L 2501/02* (2013.01); *A47L 2501/05* (2013.01); *A47L 2401/20* (2013.01); *A47L 15/241* (2013.01); *A47L 15/4208* (2013.01)

USPC ..... 134/111; 134/70; 134/56 D; 134/109; 134/104.4

(58) Field of Classification Search

USPC ..... 134/70, 111, 60, 104.2, 104.4, 110, 134/133, 137, 198, 201

See application file for complete search history.

(56) References Cited

U.S. PATENT DOCUMENTS 3,375,835 A * 4/1968 Lopp et al. ..... 134/176
3,425,078 A 2/1969 Lazaga (Continued)

FOREIGN PATENT DOCUMENTS

DE 1128094 4/1962
DE 3102547 9/1982

(Continued)

OTHER PUBLICATIONS

English translation DE4131914.*

(Continued)

*Primary Examiner* — Eric Golightly
*Assistant Examiner* — Arlyn I Rivera-Cordero
(74) *Attorney, Agent, or Firm* — Thompson Hine LLP

(57) ABSTRACT

A dishwasher has a wash system with a nozzle system with at least one wash nozzle for spraying wash liquid, a wash tank, and a wash pump by means of which wash liquid collected in the wash tank is fed to the at least one wash nozzle. A dirt-collecting system has at least one tank-covering screen to separate off particles of dirt from the wash liquid. The dirt-collecting system also has a dirt-collecting region arranged in the wash system and is intended for collecting the particles of dirt which have been separated off from the wash liquid with the aid of the tank-covering screen, wherein the dirt-collecting region is open at the top, but closed all the way around the sides, and wherein there is also a dirt-discharging pipe system by means of which the particles of dirt collected in the dirt-collecting region are discharged from the wash system.

12 Claims, 4 Drawing Sheets

(56) References Cited

U.S. PATENT DOCUMENTS

| | | | | |
|---|---|---|---|---|
| 5,097,855 | A | 3/1992 | Martinsson et al. | |
| 6,079,427 | A * | 6/2000 | Perry, Jr. | 134/104.4 |
| 8,303,726 | B2 * | 11/2012 | Beaudet et al. | 134/56 D |
| 2008/0041419 | A1 * | 2/2008 | Gaus | 134/10 |

FOREIGN PATENT DOCUMENTS

| | | | | |
|---|---|---|---|---|
| DE | 3842640 | | 6/1990 | |
| DE | 4131914 | * | 4/1993 | A47L 15/42 |
| DE | 29823869 | | 1/2000 | |
| DE | 202005015387 | | 1/2006 | |
| DE | 102006026817 | | 1/2008 | |
| EP | 0455151 | * | 11/1991 | A47L 15/42 |
| EP | 1649797 | * | 4/2006 | A47L 15/42 |
| FR | 2613609 | | 10/1988 | |
| GB | 805489 | * | 12/1958 | A47L 15/42 |
| GB | 2204482 | | 11/1988 | |

OTHER PUBLICATIONS

PCT, International Preliminary Report on Patentability, International Application No. PCT/US2010/045685 (Apr. 19, 2012).

DE, Office Action, German Application No. 10 2009 048 810.3 (Dec. 2, 2010).

PCT, International Search Report and Written Opinion, PCT/US2010/045685 (Apr. 27, 2011).

* cited by examiner

CONVEYOR WAREWASHER HAVING AN AUTOMATIC WASTEWATER REMOVAL SYSTEM

The invention relates to a dishwasher according to the preamble of Patent Claim 1. Accordingly, the invention relates, in particular, to a commercial dishwasher or utensil washer which is designed in the form of a box-type dishwasher or of a conveyor dishwasher.

The invention is thus directed to a dishwasher which has at least one wash zone designed in the form of a recirculation circuit. The wash zone designed in the form of a recirculation circuit has a nozzle system with at least one wash nozzle for spraying wash liquid onto the wash ware which is to be cleaned, also has a wash tank for collecting at least some of the sprayed wash liquid, and additionally has a wash pump by means of which wash liquid collected in the wash tank is fed to the at least one wash nozzle. The dishwasher also has a dirt-collecting system which is assigned to the at least one wash zone and has at least one tank-covering screen, in order to separate off particles of dirt from the wash liquid which has been sprayed and flows back into the wash tank under gravitational force.

Box-type dishwashers are dishwashers which can be loaded and unloaded manually. The box-type dishwashers (box-type ware washers, also referred to as batch dishwashers), may be in the form of hood-type dishwashers (hood-type ware washers) or front-loader dishwashers (front-loader ware washers). Front-loader dishwashers may be in the form of under-counter machines, counter-top machines or free-standing front-loader dishwashers.

A dishwasher designed in the form of a box-type dishwasher usually has a treatment chamber for cleaning wash ware. The treatment chamber usually has arranged beneath it a wash tank, in which liquid can flow back out of the treatment chamber under gravitational force. The wash tank contains wash liquid, which is usually water to which, if appropriate, detergent can be fed.

A dishwasher designed in the form of a box-type dishwasher also has a wash system having a wash pump, having a conduit system connected to the wash pump and having a nozzle system with at least one wash nozzle. The wash liquid located in the wash tank can be delivered by the wash pump, via the conduit system, to the at least one wash nozzle and sprayed in the treatment chamber, by this at least one wash nozzle, onto the wash ware which is to be cleaned. The sprayed wash liquid then flows back into the wash tank under gravitational force.

Conveyor dishwashers (conveyor ware washers) are in the form, in particular, of flight-type dishwashers (flight-type ware washers) or rack-conveyor dishwashers (rack-conveyor ware washers). Conveyor dishwashers are usually used in the commercial sector. In contrast to box-type dishwashers, in which the wash ware which is to be cleaned remains stationary in the machine during cleaning, the wash ware is transported, in conveyor dishwashers, through various treatment zones of the conveyor dishwasher.

A conveyor dishwasher usually has at least one pre-wash zone and at least one main-wash zone, which is arranged downstream of the pre-wash zone(s), as seen in the transporting direction of the wash ware. At least one post-wash or pre-rinse zone and at least one final-rinse zone, arranged downstream of the post-wash zone(s), are usually arranged downstream of the main-wash zone(s), as seen in the transporting direction. The wash ware, which is either accommodated directly on the transporting belt or retained by racks, usually runs, as seen in the transporting direction, through an entry tunnel, the following pre-wash zone(s), main-wash zone(s), post-wash zone(s), final-rinse zone(s), and a drying zone into an exit section.

The aforementioned wash zones of the conveyor dishwasher are each assigned a wash system which has a wash pump and a conduit system (washing-conduit system) which is connected to the wash pump and via which wash liquid is fed to the nozzle system or the at least one wash nozzle of the nozzle system. The wash liquid fed to the at least one wash nozzle of the nozzle system is sprayed, in the respective wash zones of the conveyor dishwasher, onto the wash ware, which is transported through the respective wash zones by a transporting arrangement of the conveyor dishwasher. Each wash zone is assigned a tank in which the liquid sprayed by the wash nozzle is accommodated and/or in which liquid for the nozzle systems of the relevant treatment zones is supplied.

In the case of the conveyor dishwashers which are known customarily from the prior art, final-rinse liquid in the form of clean water, which may be in pure form or mixed with further additives, for example rinse aid, is sprayed onto the wash ware via the spray nozzles of the final-rinse zone. At least some of the sprayed final-rinse liquid is transported from zone to zone via a cascade system counter to the transporting direction of the wash ware.

The sprayed final-rinse liquid is collected in a tank (post-wash tank) of the post-wash zone, from which it is delivered to the spray nozzles (post-wash nozzles) of the post-wash zone via the wash pump of the wash system belonging to the post-wash zone. In the post-wash zone, wash liquid is washed off the wash ware. The liquid which accumulates here flows into the wash tank of the at least one main wash zone, which is arranged upstream of the post-wash zone, as seen in the transporting direction of the wash ware. Here, the liquid is usually provided with a detergent and sprayed onto the wash ware, via the nozzles (wash nozzles) of the main-wash zone, by a pump system (wash pump) belonging to the wash system of the main-wash zone. From the wash tank of the main-wash zone, the liquid—insofar as there is no further main-wash zone provided—then flows into the pre-wash tank of the pre-wash zone. The liquid in the pre-wash tank is sprayed onto the wash ware, via the pre-wash nozzles of the pre-wash zone, by a pump system (pre-wash pump) belonging to the wash system of the pre-wash zone, in order to remove coarse contaminants from the wash ware.

Dishwashers are usually equipped with washing pumps by means of which the final-rinse liquid which is to be sprayed is fed to the conduit system of the final-rinse zone. This ensures, in particular, a more or less constant volume flow of the final-rinse liquid in the final-rinse zone. However, it is also conceivable to utilize the on-site line pressure—for example the pressure of the clean-water feed space—in order to direct the final-rinse liquid to the conduit system of the final-rinse zone. In this last-mentioned case, an activatable valve may be provided between the conduit system and the spray nozzles of the final-rinse zone in order for it to be possible to achieve a temporary or full interruption in the feed of final-rinse liquid to the spray nozzles.

Irrespective of whether a dishwasher is designed in the form of a box-type dishwasher or of a conveyor dishwasher, commercial dishwashers thus usually comprise at least one wash system which is designed in the form of a recirculation circuit and has a nozzle system with at least one wash nozzle for spraying wash liquid onto the wash ware which is to be cleaned, a wash tank for collecting at least some of the sprayed wash liquid, and at least one wash pump by means of which liquid collected in the wash tank is fed to the at least one wash nozzle.

Since a wash zone designed in the form of a recirculation circuit is used for cleaning the wash ware, at least some of the wash liquid already sprayed in the wash zone is channeled around a circuit, and there is therefore a risk of the particles of dirt (e.g., food particles or debris) removed from the wash ware being subjected to repeated comminution, on account of the permanent circulation of the wash liquid, and thus no longer being capable of being readily separated off from the wash liquid by screening arrangements, etc. There is thus a risk, in the case of a wash zone designed in the form of a recirculation circuit, of the contamination of the wash liquid in the wash zone increasing as time goes on, and therefore there is a greater risk of wash ware being recontaminated and the washing result worsening overall.

This problem arises, in particular, in the case of the pre-wash or main-wash zones of the dishwasher designed in the form of a conveyor dishwasher. Since, in the case of conveyor dishwashers, the wash liquid used flows in cascade form counter to the transporting direction of the wash ware which is to be cleaned, the concentration of dirt in the wash liquid in the at least one pre-wash zone is greater than the concentration of dirt in the wash liquid in the rest of the treatment zones since most dirt accumulates in the pre-wash zone.

On the other hand, it is not possible to avoid the situation where, during operation of a dishwasher designed in the form of a conveyor dishwasher, some of the more contaminated wash liquid in the pre-wash zone is "entrained", by the transportation of the wash ware, into the at least one main-wash zone, which is arranged downstream of the pre-wash zone. This increases the contamination of the wash liquid in the main-wash zone and, accordingly, the washing result in the main-wash zone can likewise worsen.

In order for the particles of dirt introduced into the dishwasher to be separated from the wash liquid used for washing the wash ware, it is generally known to use screening arrangements in the form of dirt-screening baskets, in which the particles of dirt introduced into the dishwasher collect. In the case of dishwashers designed in the form of box-type dishwashers, such a dirt-screening basket is usually arranged in the treatment chamber in the wash tank.

On the other hand, in respect of dishwashers which are designed in the form of conveyor dishwashers, it is known for at least the pre-wash tank, which is assigned to the pre-wash zone, and preferably also the main-wash tank, which is assigned to the at least one main-wash zone, to be equipped with planar screens and dirt-screening baskets.

During operation of the dishwasher, designed either as a box-type dishwasher or as a conveyor dishwasher, the particles of dirt washed off the wash ware with the aid of the circulating wash water then fall onto the planar screens under gravitational force. The particles of dirt are separated there from the wash liquid flowing back into the corresponding wash tank. The separated-off particles of dirt are then usually washed into a dirt-screening basket.

The present invention is based on the problem that, in the case of the solutions which are known previously from the prior art and in the case of which planar screens and/or dirt-screening baskets are used for separating off particles of dirt from a circulating wash liquid, there is a risk of the particles of dirt which collect on the planar screen and/or in the dirt-screening basket being comminuted as time goes on by the permanent circulation of the wash liquid, to the extent that the particles of the dirt have a particle size which is no longer retained by the mesh width of the planar screen and/or dirt-screening basket and therefore, despite a planar screen or dirt-screening basket being provided, it is no longer possible to prevent the situation where more and more particles of dirt collect in the wash liquid as time goes on.

Taking this problem as a starting point, it is an object of the invention to develop a dishwasher of the type mentioned in the introduction to the extent that, in an effective but nevertheless easy-to-realize manner, the risk of the wash ware being recontaminated is reduced and the washing result overall can be improved.

This object is achieved according to the invention in that a dishwasher of the type mentioned in the introduction is provided with a dirt-collecting system which is assigned to the at least one wash system and has at least one tank-covering screen, in order to separate off particles of dirt from the wash liquid which has been sprayed and flows back into the wash tank of the wash system, designed in the form of a recirculation circuit, under gravitational force, wherein the dirt-collecting system also has a dirt-collecting region which is arranged in the wash system and is intended for collecting the particles of dirt which have been separated off from the wash liquid with the aid of the tank-covering screen. The dirt-collecting region is upwardly open in order to allow the feed of particles of dirt which have been separated off with the aid of the tank-covering screen. However, the sides of the dirt-collecting region are closed all the way around, and this therefore prevents even fine and extra-fine dirt from being discharged from the dirt-collecting region. In the case of the solution according to the invention, it is also provided that the dirt-collecting system, in addition, has a dirt-discharging pipe system which is connected to the dirt-collecting region and by means of which the particles of dirt collected in the dirt-collecting region are discharged from the wash system.

Many advantages which can be achieved by the solution according to the invention. The provision, on the one hand, of the tank-covering screen, designed preferably as a planar screen, and, on the other hand, of the dirt-collecting system ensures that the particles of dirt washed off the wash ware in the wash system and the particles of dirt introduced into the wash liquid in some other way can be separated effectively from the wash liquid and collected and/or concentrated in the dirt-collecting region. Since the dirt-collecting region is closed (i.e. fluid-tight) all the way around the sides, the particles of dirt collected in the dirt-collecting region are encapsulated in relation to the wash liquid in the wash tank, and therefore even relatively small particles of dirt which arise possibly as a result of disintegration of the particles of dirt collected in the dirt-collecting region cannot pass back again into the wash liquid accommodated in the wash tank.

On the other hand, it is provided, in the case of the solution according to the invention, that the dirt-collecting region is connected to a dirt-discharging pipe system via which the particles of dirt collected in the dirt-collecting region can be channeled out of the wash system. This makes it possible to reduce the residence time of the particles of dirt in the dirt-collecting region, and thus in the wash system, and it is therefore no longer possible for dirt to disintegrate as a result of the wash liquid circulating in the wash system.

Accordingly, the solution according to the invention achieves a constant washing result even over a lengthy wash period, recontamination of the wash ware by particles of dirt in the wash liquid being effectively prevented.

On the other hand, the solution according to the invention provides an effective method of discharging particles of dirt from the wash liquid, and it is therefore possible to realize a longer service life for the wash liquid in comparison with conventional solutions. It is thus possible to use the wash liquid for cleaning a relatively large quantity of crockery before this wash liquid has to be changed. This cuts down on the use, in particular, of clean water, detergent and heating energy.

In a preferred realization of the solution according to the invention, it is provided that the dirt-collecting system has at least one activatable valve arranged in the dirt-discharging pipe system in order if required, or at predetermined times or in the case of predetermined events, to connect the dirt-collecting region optionally to a dirt-collecting container formed outside the wash system or to a waste-disposal system formed outside the dishwasher. It is thus possible in the case of this embodiment, by activation of the valve arranged in the dirt-discharging pipe system, to connect the dirt-collecting region to the dirt-collecting container or the waste-disposal system, and therefore the particles of dirt collected in the dirt-collecting region can be discharged, for example under gravitational force, from the dirt-collecting region and thus from the wash zone or the dishwasher.

As an alternative, or in addition, to the aforementioned embodiment, it is also conceivable for the dirt-collecting system to have at least one dirty-water pump which is arranged in the dirt-discharging pipe system and by means of which the particles of dirt collected in the dirty-water-collecting region are actively fed either to a dirt-collecting container formed outside the wash system or to a waste-disposal system formed outside the dishwasher. The dirty-water pump is preferably configured here in order that the particles of dirt collected in the dirt-collecting region are channeled out of the wash system continuously or at predetermined times or in the case of predetermined events.

Accordingly, the solution according to the invention means that the particles of dirt collected in the at least one wash system of the dishwasher with the aid of the dirt-collecting system can also be removed automatically from the dishwasher. Such automatic discharge of dirt relieves the dishwasher operator or operators of responsibility. Furthermore, it is effectively possible to prevent the situation where the recirculation of the wash liquid in the wash zone is influenced or blocked by overfilling of the dirt-collecting region.

Exemplary embodiments of the solution according to the invention will be described in more detail hereinbelow with reference to the accompanying drawings, in which.

Figure 1:
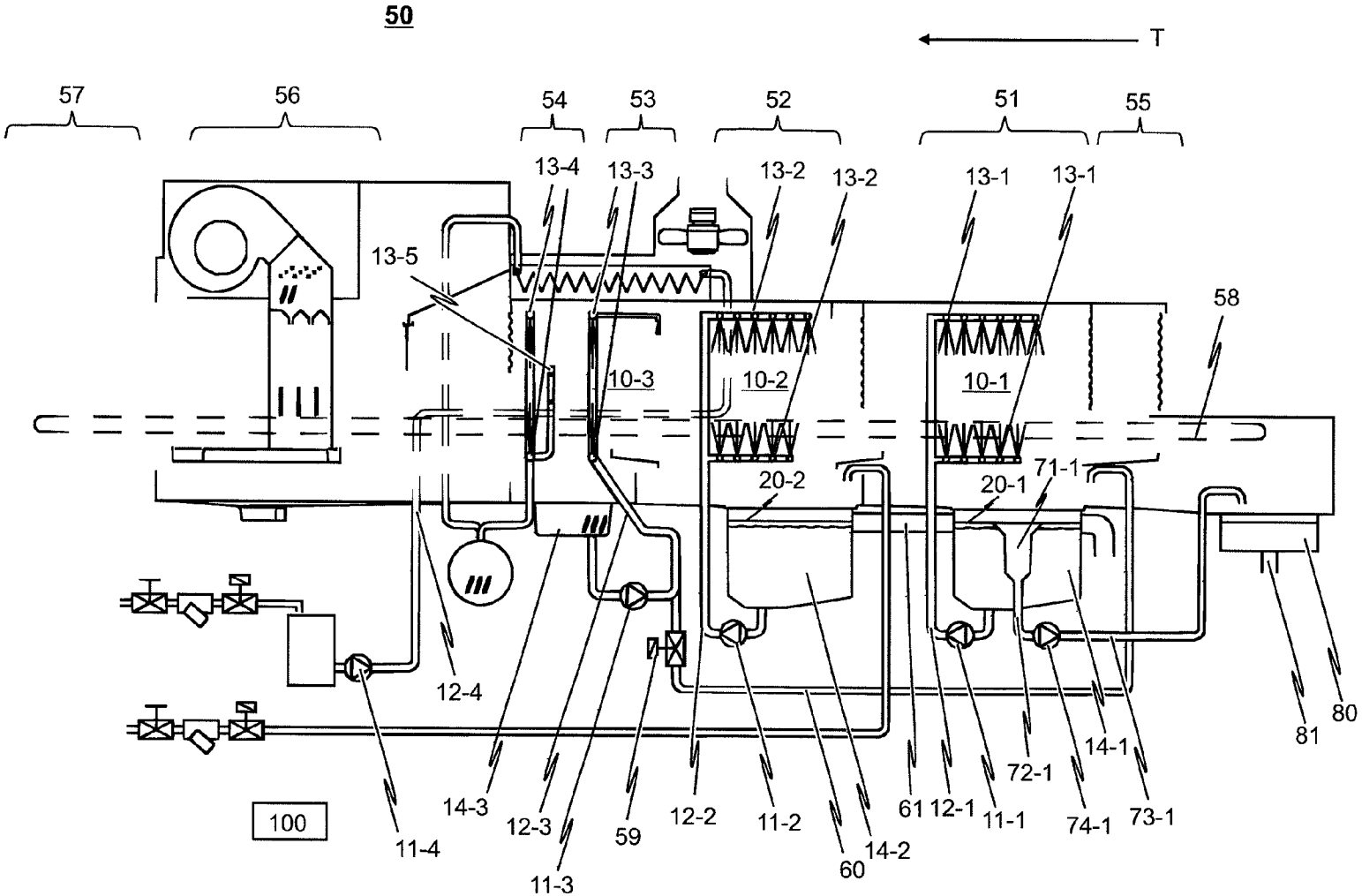
FIG. 1 shows, schematically, a first embodiment of a dishwasher designed in the form of a conveyor dishwasher.

FIG. 1 shows a schematic view, in longitudinal section, of an example of a conveyor dishwasher 50 designed according to the teaching of the present invention. The conveyor dishwasher 50 according to the illustration in FIG. 1 has a pre-wash zone 51 and a main-wash zone 52, which is arranged downstream of the pre-wash zone 51, as seen in the transporting direction T of the wash ware (not illustrated in FIG. 1). In the case of the conveyor dishwasher 50 illustrated in FIG. 1, a post-wash or pre-rinse zone 53 and a final-rinse zone 54, arranged downstream of the post-wash or pre-rinse zone 53, are arranged downstream of the main-wash zone 52, as seen in the transporting direction T.

In the case of the conveyor dishwasher 50 illustrated, at least the pre-wash zone 51 and the main-wash zone 52 are each designed as wash system 10-1 and wash system 10-2, respectively.

The wash ware, which is either accommodated directly on a transporting belt 58 or retained by racks, runs, as seen in the transporting direction T, through an entry tunnel 55, the following pre-wash zone 51, the main-wash zone 52, the post-wash zone 53, the final-rinse zone 54 and a drying zone 56 into an exit section 57.

The aforementioned treatment zones 51, 52, 53, 54 of the conveyor dishwasher 50 are each assigned spray nozzles 13-1, 13-2, 13-3, 13-4 via which liquid is sprayed onto the wash ware, which is transported through the respective treatment zones 51, 52, 53, 54 by the transporting belt 58. At least the pre-wash zone 51, the main-wash zone 52 and the post-wash or pre-rinse zone 53 are each assigned a tank (wash tank 14-1, 14-2, 14-3) in which sprayed wash liquid is accommodated and/or wash liquid for the spray nozzles 13-1, 13-2, 13-3 of the relevant zones 51, 52, 53 is supplied.

The pre-wash zone 51, the main-wash zone 52 and the post-wash zone 53 of the conveyor dishwasher 50 according to the first embodiment of the invention, which is illustrated in FIG. 1, each have a wash system 10-1, 10-2, 10-3. Each wash system 10-1, 10-2, 10-3 is made up of a wash pump 11-1, 11-2, 11-3, of a conduit system 12-1, 12-2, 12-3, which is connected to the wash pump 11-1, 11-2, 11-3, and of the spray nozzles 13-1, 13-2, 13-3, which are connected to the conduit system 12-1, 12-2, 12-3.

Also provided is a control device 100 which is illustrated schematically in the figures and serves (inter alia) for appropriately activating the respective wash pumps 11-1, 11-2, 11-3 of the wash systems 10-1, 10-2, 10-3 during a wash process in order for a wash liquid to be fed at least temporarily via the associated conduit system 12-1, 12-2, 12-3, to the spray nozzles 13-1, 13-2, 13-3 of the nozzle system associated with the respective wash system 10-1, 10-2, 10-3.

In the case of the conveyor dishwasher 50 illustrated in FIG. 1, final-rinse liquid in the form of clean water, which may be mixed with further chemical additives, for example rinse aid, is sprayed onto the wash ware (not illustrated in FIG. 1) via the spray nozzles 13-4 of the final-rinse zone 54, these nozzles being arranged above and beneath the transporting belt 58. As is illustrated in FIG. 1, laterally arranged spray nozzles 13-5 may also be provided in the final-rinse zone 54.

Some of the final-rinse liquid sprayed in the final-rinse zone 54 is transported from zone to zone via a cascade system counter to the transporting direction T of the wash ware. The rest is channeled directly into the pre-wash tank 14-1 of the pre-wash zone 51 via a valve 59 and a bypass line 60.

The final-rinse liquid sprayed in the final-rinse zone 54 is collected in the tank (post-wash or pre-rinse tank 14-3) of the post-wash or pre-rinse zone 53, from which it is delivered to the spray nozzles 13-3 (post-wash or pre-rinse nozzles) of the post-wash or pre-rinse zone 53 via the wash pump 11-3 belonging to the wash system 10-3 of the post-wash or pre-rinse zone 53. Wash liquid is washed off the wash ware in the post-wash or pre-rinse zone 53.

The liquid which accumulates here flows into the wash tank 14-2 of the main-wash zone 52, is usually provided with a detergent and is sprayed onto the wash wear via the spray nozzles 13-2 (wash nozzles) of the wash system 10-2 belonging to the main-wash zone 52 with the aid of a wash pump 11-2 belonging to the wash system 10-2 of the main-wash zone 52.

From the wash tank 14-2 of the main-wash zone 52, the wash liquid then flows into the pre-wash tank 14-1 of the pre-wash zone 51. The wash liquid collected in the pre-wash tank 14-1 is sprayed onto the wash ware in the pre-wash zone 51 via the spray nozzles 13-1 (pre-wash nozzles) of the wash system 10-1 belonging to the pre-wash zone 51, with the aid of a wash pump 11-1 belonging to the wash system 10-1 of the pre-wash zone 51, in order to remove coarse contaminants from the wash ware.

In the case of the conveyor dishwasher 50 illustrated in FIG. 1, the main-wash zone 52 has a tank-covering screen 20-2, which is arranged above the main-wash tank 14-2. During operation of the conveyor dishwasher 50, wash liquid is sprayed onto the wash ware via the spray nozzles 13-2 (wash nozzles) of the wash system 10-2. The sprayed wash liquid flows back into the wash tank 14-2 of the main-wash zone 52 under gravitational force, wherein the particles of dirt washed off the wash ware in the main-wash zone 52 are retained by the tank-covering screen 20-2, provided that the particles of dirt are larger than the mesh width of the tank-covering screen 20-2. The mesh width of the tank-covering screen 20-2 is preferably approximately 1 mm to 4 mm.

In the case of the conveyor dishwasher 50 illustrated schematically in FIG. 1, for the purpose of cleaning the tank-covering screen 20-2, the washing operation has to be interrupted in order to allow the tank-covering screen 20-2 to be cleaned manually.

Some of the wash liquid sprayed in the main-wash zone 52 passes into the wash tank (pre-wash tank 14-1) of the pre-wash zone 51 via an overflow system 61. Like the main-wash zone 52, the pre-wash zone 51 is equipped with a tank-covering screen 20-1 designed in the form of a planar screen. This tank-covering screen 20-1 is arranged above the wash tank (pre-wash tank 14-1) of the pre-wash zone 51, in order to separate off particles of dirt from the wash liquid which has been sprayed in the pre-wash zone 51 and flows back into the pre-wash tank 14-1 under gravitational force. The mesh width of the tank-covering screen 20-1 is preferably in a range of between approximately 1 mm and 4 mm.

Since—as explained in the introduction—the concentration of dirt in the wash liquid is at its greatest in the pre-wash zone 51, since most dirt accumulates here, the conveyor dishwasher 50 illustrated in FIG. 1 is equipped with a dirt-collecting system 70 which is assigned to the pre-wash zone 51 and has a dirt-collecting region 71-1 arranged in the pre-wash zone 51, and in particular within the pre-wash tank 14-1. The construction and the functioning of the dirt-collecting system 70 used for the conveyor dishwasher 50 illustrated in FIG. 1 will be described in more detail hereinbelow with reference to the illustration in FIG. 4.

In the case of that embodiment of the conveyor dishwasher 50 which is illustrated in FIG. 1, the dirt-collecting region 71 serves for collecting the particles of dirt separated off from the wash liquid with the aid of the tank-covering screen 20-1. Specifically, and as will be described in more detail hereinbelow, with reference to the illustration in FIG. 4, the dirt-collecting region 71-1 is designed in the form of a chamber which is arranged in the pre-wash tank 14-1 and is closed all the way around the sides, but is open at the top, and therefore the particles of dirt separated off with the aid of the tank-covering screen 20-1 can pass into the chamber-like dirt-collecting region 71-1 via this opening. Since the dirt-collecting region 71 is closed all the way around the sides, it is effectively possible to prevent the situation where the particles of dirt collected in the dirt-collecting region 71-1 pass back into the pre-wash tank 14-1 and can contaminate the wash liquid collected in the pre-wash tank 14-1.

Specifically, and as will be described in more detail hereinbelow with reference to the illustration in FIG. 4, it is preferred if the tank-covering screen 20-1 is arranged above the dirt-collecting region 71-1 and has a runout slope in the form of a gradient directed toward a feed opening 22, the dirt-collecting region 71-1, which is open at the top, being arranged beneath the feed opening 22, and therefore the particles of dirt separated off with the aid of the tank-covering screen 20-1 can pass into the dirt-collecting region 71-1 via the feed opening 22.

Figure 4:
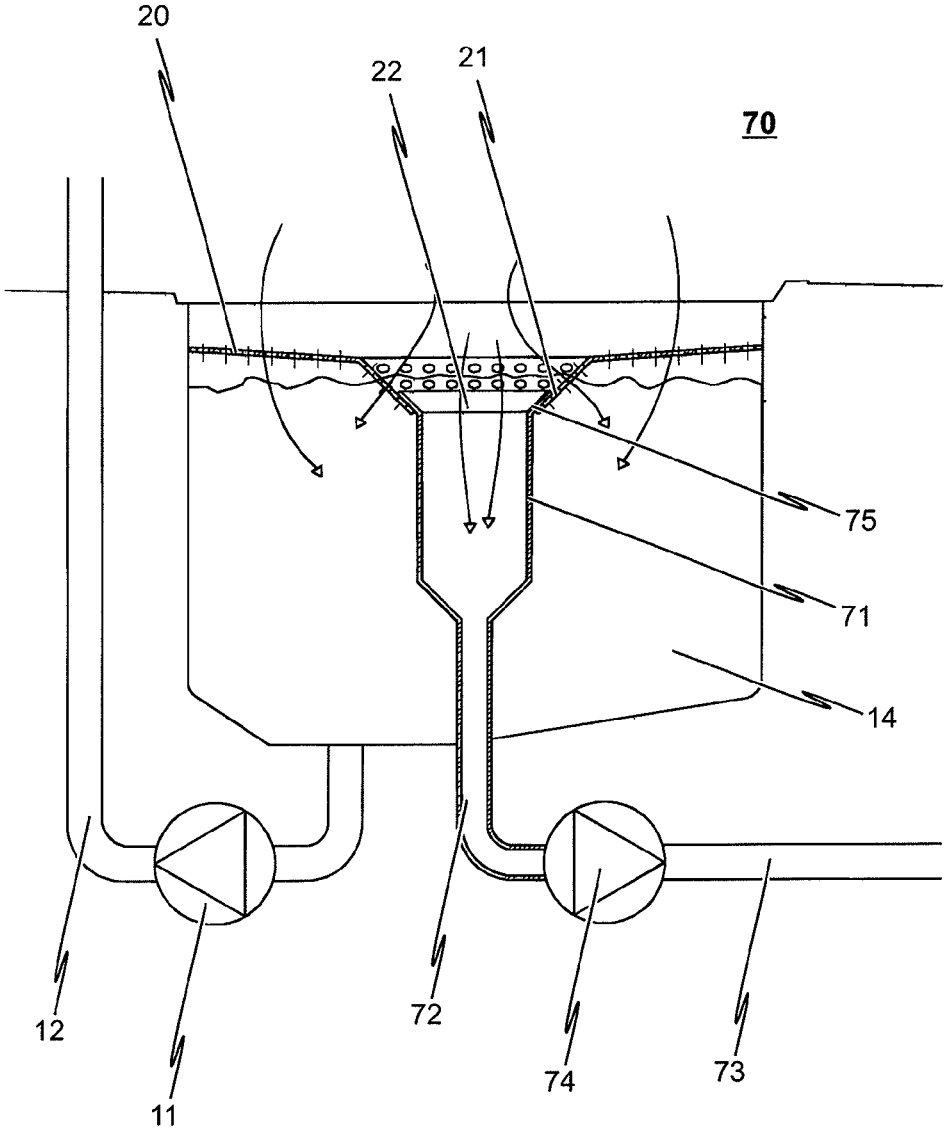
FIG. 4 shows, schematically, the wash tank of a wash system of a dishwasher designed in the form of a conveyor dishwasher or of a box-type dishwasher, the wash tank having one embodiment of a dirt-collecting system.

It is conceivable here, in particular, for the tank-covering screen 20-1 to be designed, at least in certain regions, in a funnel-like manner wherein the feed opening 22 is formed within the funnel-like region 21 of the tank-covering screen 20-1, and preferably in the center of the funnel-like region 21 of the tank-covering screen 20-1 (cf., in this respect, in particular also the illustration in FIG. 4). The portions of the screen 20-1 radially exterior of the funnel-like region may also be formed with a slight gradient the feeds down to the steeper funnel area.

The dirt-collecting system 70 used for the embodiment illustrated in FIG. 1 also has a dirt-discharging pipe system which is connected to the dirt-collecting region 71-1, comprises a vertical pipe 72-1 and a dirty-water conduit 73-1 and by means of which the particles of dirt collected in the dirt-collecting region 71-1 are discharged from the pre-wash zone 51. As illustrated, a dirty-water pump 74-1 is arranged in the dirt-discharging pipe system 72-1, 73-1. The inlet on the suction side of the dirty-water pump 74-1 is connected to the bottom region of the dirt-collecting region 71-1 via the vertical pipe 72-1 belonging to the dirt-discharging pipe system 72-1, 73-1. The outlet on the pressure side of the dirty-water pump 74-1 opens out in the dirty-water conduit 73-1 belonging to the dirt-discharging pipe system.

In the case of the embodiment illustrated in FIG. 1, the dirty-water conduit 73-1 leads to an external dirt-collecting container 80 which is arranged outside the pre-wash zone 51, upstream of the entry tunnel 55 of the conveyor dishwasher 50. This external dirt-collecting container 80 preferably has a screen and a connection 81 to a waste-water system.

Since, when wash liquid is sprayed in the pre-wash zone 51, it is not possible to prevent the situation where some of the sprayed wash liquid passes into the dirt-collecting region 71, the dirty-water pump 74-1 delivers from the pre-wash zone 51 not only the particles of dirt separated off with the aid of the tank-covering screen 20-1 but also some of the wash liquid. The material channeled out of the dirt-collecting region 71-1 (particles of dirt and wash liquid) is screened in the dirt-collecting container 80, wherein the liquid constituent parts (wash liquid) can be fed to a waste-water system via the outflow connection 81 and the solids remaining in the dirt-collecting container 80 (particles of dirt) can then be disposed of.

Figure 2:
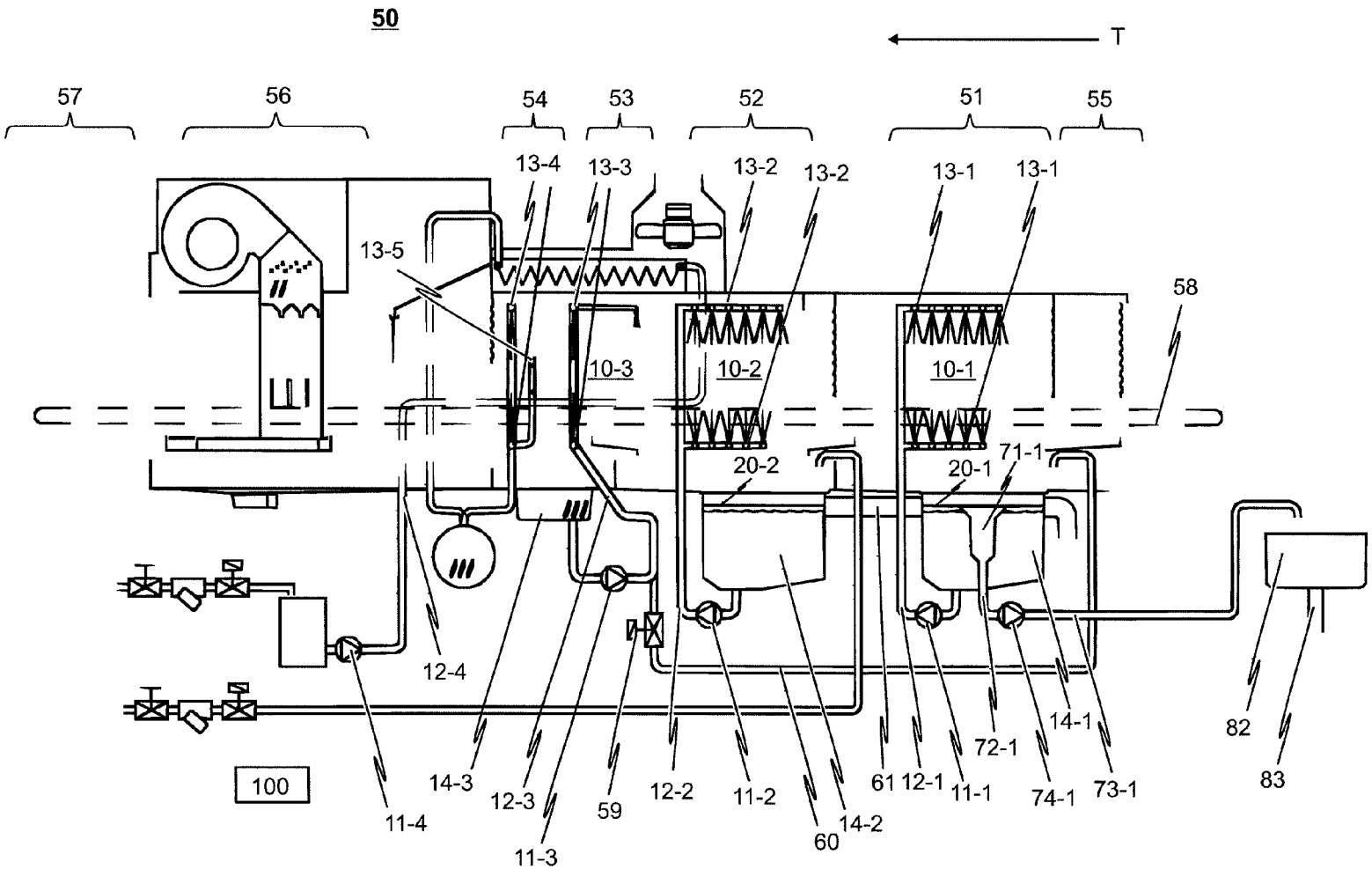
FIG. 2 shows, schematically, a second embodiment of a dishwasher designed in the form of a conveyor dishwasher.

As is illustrated in FIG. 2, it is also conceivable, as an alternative to the embodiment illustrated in FIG. 1, for the particles of dirt to be pumped out of the pre-wash zone 51 into a waste-disposal system 82 along with the waste water, wherein this system 82 can be placed in position either directly alongside the conveyor dishwasher 50 or further away. Possible waste-disposal systems 82 which can be used are squeezing-out systems for separating solids and liquids and/or comminuting systems (grinding systems, chopping systems, etc.). The material channeled out of the dirt-collecting region 71-1 (particles of dirt and wash liquid) is preferably likewise screened in the waste-disposal system 82, wherein the liquid constituent parts (wash liquid) can be fed to a waste-water system via an outflow connection 83 and the solids remaining in the waste-disposal system 82 (particles of dirt) can then be disposed of.

Figure 3:
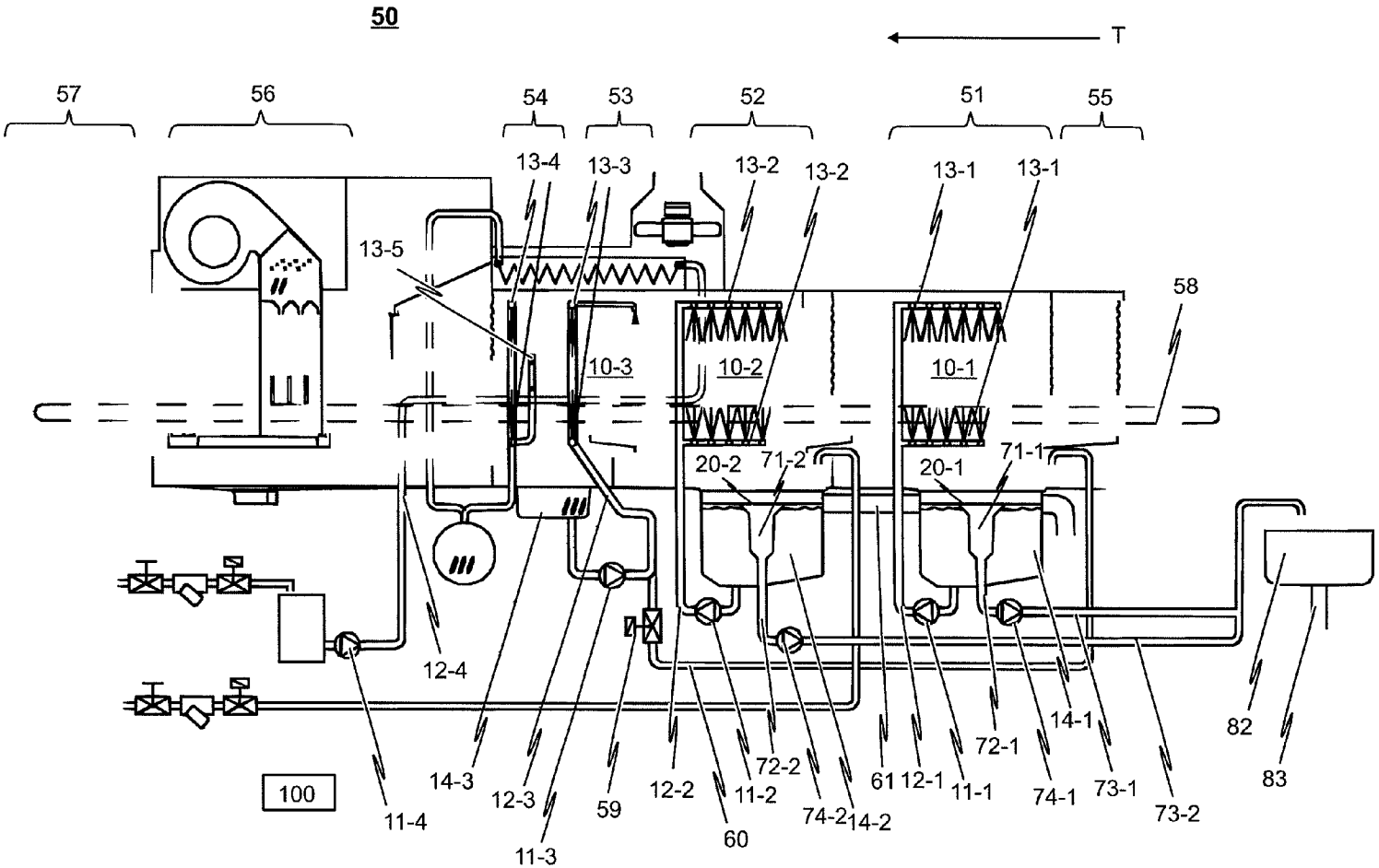
FIG. 3 shows, schematically, a third embodiment of a dishwasher designed in the form of a conveyor dishwasher.

FIG. 3 illustrates a further embodiment of the conveyor dishwasher 50 designed according to the teaching of the present invention. This embodiment is essentially identical to the embodiment which has been described above with reference to the illustration in FIG. 1 or FIG. 2, with the exception that it is not just the pre-wash zone 51, but also the main-wash zone 52, which is equipped with a dirt-collecting system 70, the construction and functioning of which will be described in more detail hereinbelow with reference to the illustration in FIG. 4.

In contrast to the embodiment illustrated in FIG. 1, in the case of the conveyor dishwasher 50 shown in FIG. 3, a tank-covering screen 20-2, which has a feed opening 22 (cf. FIG. 4), is provided in or above the main-wash tank 14-2, wherein a dirt-collecting region 71-2 which is open at the top is arranged beneath the feed opening 22. In this dirt-collecting region 71-2, the particles of dirt separated off with the aid of the tank-covering screen 20-2 are introduced into the dirt-collecting region 71-2 via the feed opening 22.

In the case of the embodiment of the solution according to the invention which is illustrated in FIG. 3, a dirt-discharging pipe system comprising a dirty-water conduit 73-2 and a vertical pipe 72-2 is provided at the bottom of the dirt-collecting region 71-2. The material collected in the dirt-collecting region 71-2 (wash liquid and separated-off particles of dirt) passes, via a dirty-water pump 74-2, into a dirt-collecting container 80 formed outside the main-wash zone 52 or into a waste-disposal system 82 formed outside the conveyor dishwasher 50.

The construction and functioning of the dirt-collecting system 70 will be described in more detail hereinbelow with reference to the illustration in FIG. 4.

The dirt-collecting system 70 is arranged within a wash tank 14 of a conveyor dishwasher 50 or of a dishwasher designed in the form of a box-type dishwasher. The dirt-collecting system 70 has a tank-covering screen 20 which is arranged preferably in the wash tank 14, above the level of the wash liquid accommodated in the wash tank 14. The tank-covering screen 20 serves to separate off particles of dirt from the wash liquid which has been sprayed and flows back into the wash tank under gravitational force. For this reason, a suitable mesh width has to be provided for the tank-covering screen 20.

The dirt-collecting system 70 also has a dirt-collecting region 71 which is designed in the form of a fully closed chamber and is open at the top. The particles of dirt separated off by the tank-covering screen 20 are fed to the chamber-form dirt-collecting region 71 via the opening of the latter. For this purpose, it is preferred if the tank-covering screen 20 has a runout slope in the form of a gradient directed toward a feed opening 22, the dirt-collecting region 71, which is open at the top, being arranged beneath the feed opening 22. As is illustrated in FIG. 4, it is conceivable, for example, for the tank-covering screen 20 to be designed, at least in certain regions, in a funnel-like manner, wherein the feed opening 22 is formed within the funnel-like region 21 of the tank-covering screen 20, and preferably in the tapered region of the funnel-like region 21 of the tank-covering screen 20.

Furthermore, it is preferred if the dirt-collecting region 71 is formed in a funnel-like manner at the top end (cf. the funnel-like region 75 in FIG. 4), in order for it to be possible to be inserted into, and accommodated in, the feed opening 22 of the tank-covering screen 20.

Wash liquid is sprayed in the wash zone during operation of the dishwasher (not shown in FIG. 4), wherein some of the sprayed wash liquid flows back into the wash tank 14 via the tank-covering screen 20. The rest of the sprayed wash liquid flows directly, under gravitational force, into the dirt-collecting region 71 via the feed opening 22 provided in the tank-covering screen 20. The particles of dirt washed off the wash ware during washing—provided they are larger than the mesh width of the tank-covering screen 20—are prevented by the tank-covering screen 20 from passing into the wash liquid collected in the wash tank 14. Rather, the particles of dirt separated off by the tank-covering screen 20 are moved by way of the runout slope to the feed opening 22 and thus pass into the dirt-collecting region 71. Since the side walls of the dirt-collecting region 71 are closed all the way around, it is no longer possible for the particles of dirt collected in the dirt-collecting region 71 to pass into the wash liquid which is collected in the wash tank 14. Even when the particles of dirt collected in the dirt-collecting region 71 are comminuted further by the action of wash liquid falling downward, this dirt still cannot pass into the wash liquid collected in the wash tank 14 and thus increase the contamination of the wash liquid.

In order for it to be possible for the dirt-collecting region 71 to be emptied preferably automatically, the dirt-collecting system 70 preferably also has a dirt-discharging pipe system. This dirt-discharging pipe system, in the case of the embodiment of the dirt-discharging system 70 which is illustrated in FIG. 4, comprises a vertical pipe 72, which is connected to the bottom region of the dirt-collecting region 71. The vertical pipe 72 is connected to the inlet on the suction side of a dirty-water pump 74. The outlet on the pressure side of the dirty-water pump 74 opens out in a dirty-water conduit 73, and therefore, upon activation of the dirty-water pump 74, the contents of the dirt-collecting region 71 can be channeled out of the wash zone.

The dirty-water pump 74 is preferably configured in order that the particles of dirt collected in the dirt-collecting region 71 are channeled out, together with the wash liquid likewise collected in the dirt-collecting region 71, continuously or at predetermined times or in the case of predetermined events. It is conceivable here, in particular, for the dirty-water pump 74 to be activated via the already mentioned control means 100 in dependence on the quantity of particles of dirt collected in the dirt-collecting region 71.

It is nevertheless, of course, conceivable for dirt to be pumped out of the dirt-collecting region 71 in dependence, for example, on the level in the dirt-collecting region 71, on the level in the wash tank 14, or on other factors.

If the dirt-collecting system 71 is used for a conveyor dishwasher 50 (cf., for example, FIGS. 1 to 3), it is also conceivable for the dirty-water pump 74 to be activated, for example, in dependence on the transporting speed at which the wash ware is transported through the treatment zones of the conveyor dishwasher 50 or, for example, in dependence on the quantity of final-rinse liquid which is sprayed per unit of time in the final-rinse zone 54.

The invention is not restricted to the embodiments described in conjunction with the drawings.

It is thus conceivable, for example, for the tank-covering screen 20, 20-1, 20-2 of the dirt-collecting system 70 not to have an essentially central feed opening 22 via which the particles of dirt separated off with the aid of the tank-covering screen 20, 20-1, 20-2 pass into the dirt-collecting region 71, 71-1, 71-2. Rather, this feed opening 22 may also be designed in the form of a gap which is provided along a peripheral region of the tank-covering screen 20, 20-1, 20-2.

It is also conceivable, in principle, for the feed opening 22 to be covered by a coarse screen, wherein this coarse screen should preferably have a mesh width which is greater than the mesh width of the tank-covering screen 20, 20-1, 20-2. The provision of such a coarse screen can effectively prevent the situation where, for example, items of cutlery or other utensils, in contrast to dirty-water particles, pass accidentally into the dirt-collecting region 71, 71-1, 71-2.

Although the solution according to the invention in FIGS. 1 to 3 has been described in conjunction with a conveyor dishwasher 50, it is, of course, also conceivable for a dishwasher designed in the form of a box-type dishwasher to be equipped with a dirt-collecting system 70.

The invention claimed is:

1. A dishwasher, comprising:

a wash system having a nozzle system with at least one wash nozzle for spraying wash liquid onto wares to be cleaned, a wash tank for collecting at least some of the sprayed wash liquid, and a wash pump for feeding wash liquid collected in the wash tank to the wash nozzle;

a dirt-collecting system associated with the wash system and having at least one tank-covering screen in order to separate off particles of dirt from sprayed wash liquid which flows back into the wash tank under gravitational force, the dirt-collecting system having a dirt-collecting region arranged in the wash system for collecting the particles of dirt which have been separated off from the wash liquid with the aid of the tank-covering screen, wherein a dirt-discharging pipe system is connected to the dirt-collecting region for discharging the particles of dirt collected in the dirt-collecting region from the wash system, and wherein a top of the dirt-collecting region is located in an upper portion of the wash tank and is open to receive dirt from the tank-covering screen, but the dirt-collecting region extends downward through the wash tank and is closed all the way around the sides and downward from the top to the dirt-discharging pipe system such that both liquid and particles of dirt that move downward through the dirt-collecting region are prevented from reentering the wash tank for reuse in spraying;

wherein the dirt-collecting system has at least one dirty-water pump arranged in the dirt-discharging pipe system and by means of which particles of dirt collected in the dirt-collecting region are fed to at least one of a dirt-collecting container formed outside the wash system or a waste-disposal system formed outside the dishwasher;

wherein a controller is provided for activating a dirty-water pump in dependence on the quantity of particles of dirt collected in the dirt collecting region, on the level in the dirt-collecting region, on the level in the wash tank, on the transporting speed at which the wash ware is transported through the dishwasher or on other factors.

2. Dishwasher in the form of a box-type dishwasher or of a conveyor dishwasher—with at least one recirculating wash system having a nozzle system with at least one wash nozzle for spraying wash liquid onto wares to be cleaned, a wash tank for collecting at least some of the sprayed wash liquid, and a wash pump by means of which wash liquid collected in the wash tank is fed to the at least one wash nozzle, and wherein a dirt-collecting system is assigned to the at least one wash system and has at least one tank-covering screen in order to separate off particles of dirt from the wash liquid which has been sprayed and flowed back into the wash tank under gravitational force, characterized in that the dirt-collecting system also has a dirt-collecting region which is arranged below the tank covering screen in the wash system for collecting the particles of dirt which have been separated off from the wash liquid with the aid of the tank-covering screen, wherein a dirt-discharging pipe system is connected to a lower end of the dirt-collecting region and by means of which the particles of dirt collected in the dirt-collecting region are discharged from the wash system;

wherein the tank-covering screen is arranged above the dirt-collecting region and has a runout slope in the direction of a feed opening located at a top of the dirt-collecting region in an upper portion of the wash tank, wherein the upwardly open dirt-collecting region extends downwardly from the feed opening such that the particles of dirt separated off with the aid of the tank-covering screen pass into the dirt-collecting region via the feed opening, wherein the dirt-collecting region is open at the top via the feed opening, but closed all the way around the sides and downward from the feed opening through the wash tank to the dirt-discharging pipe system such that both liquid and particles of dirt that move downward into the dirt collecting region through the feed opening are prevented from reentering the wash tank for reuse in spraying.

3. Dishwasher according to claim 1, wherein the tank-covering screen is designed, at least in certain regions, in a funnel-like manner, and wherein the feed opening is formed within the funnel-like region of the tank-covering screen.

4. Dishwasher according to claim 1, wherein the feed opening is formed in a central position of the tank-covering screen.

5. Dishwasher according to claim 1, wherein a coarse screen at least partially covers the feed opening and has a mesh width which is greater than the mesh width of the tank-covering screen.

6. Dishwasher according to claim 1, wherein the dirt-collecting region is designed, at least at its top end, in the form of a funnel-like region.

7. Dishwasher according to claim 1, wherein the dirt-collecting system has at least one activatable valve arranged in the dirt-discharging pipe system in order to selectively connect the dirt-collecting region to a dirt-collecting container formed outside the wash system or to a waste-disposal system formed outside the dishwasher.

8. Dishwasher according to claim 1, which is designed in the form of a conveyor dishwasher, wherein the at least one wash system is designed in the form of at least one wash zone, and wherein the conveyor dishwasher, in addition to the at least one wash system designed in the form of a wash zone, has at least one final-rinse zone and a transporting arrangement for transporting the wash ware which is to be cleaned through the at least one wash system, which is designed in the form of a wash zone, and the final-rinse zone, which is arranged downstream of the at least one wash system as seen in the transporting direction (T) of the wash ware.

9. Dishwasher according to claim 1, which is designed in the form of a box-type dishwasher and has a treatment chamber in which the wash system is formed.

10. Dishwasher according to claim 1, wherein the dirt-collecting system has at least one dirty-water pump which is arranged in the dirt-discharging pipe system and by means of which particles of dirt collected in the dirt-collecting region are fed to a dirt-collecting container formed outside the wash system or to a waste-disposal system formed outside the dishwasher.

11. Dishwasher according to claim 10, wherein the dirty-water pump is configured in order that particles of dirt collected in the dirt-collecting region are channelled out of the wash system continuously or at predetermined times or in the case of predetermined events.

12. Dishwasher according to claim 10, wherein a control means is provided for activating the dirty-water pump in dependence on the quantity of particles of dirt collected in the dirt-collecting region.

* * * * *